US010883258B2

(12) United States Patent
Ridell

(10) Patent No.: US 10,883,258 B2
(45) Date of Patent: Jan. 5, 2021

(54) WATER RECIRCULATION DEVICE AND METHOD FOR ADJUSTING A WATER TEMPERATURE IN A WATER RECIRCULATING DEVICE

(71) Applicant: ORBITAL SYSTEMS AB, Malmö (SE)

(72) Inventor: Michael Ridell, Staffanstorp (SE)

(73) Assignee: ORBITAL SYSTEMS AB, Malmö (SE)

( * ) Notice: Subject to any disclaimer, the term of this patent is extended or adjusted under 35 U.S.C. 154(b) by 0 days.

(21) Appl. No.: 16/607,630

(22) PCT Filed: Apr. 9, 2018

(86) PCT No.: PCT/SE2018/050365
§ 371 (c)(1),
(2) Date: Oct. 23, 2019

(87) PCT Pub. No.: WO2018/199828
PCT Pub. Date: Nov. 1, 2018

(65) Prior Publication Data

US 2020/0299937 A1 Sep. 24, 2020

(30) Foreign Application Priority Data

Apr. 27, 2017 (SE) ..... 1750506

(51) Int. Cl.
*E03B 1/04* (2006.01)
*E03C 1/044* (2006.01)

(52) U.S. Cl.
CPC ..... *E03B 1/041* (2013.01); *E03C 1/044* (2013.01); *E03B 2001/045* (2013.01)

(58) Field of Classification Search
CPC ..... E03C 1/044; E03B 1/042; E03B 1/044; E03B 1/048; F24D 17/0078
See application file for complete search history.

(56) References Cited

U.S. PATENT DOCUMENTS 3,123,065 A * 3/1964 Conley ..... F24D 17/0078 122/13.3
5,353,448 A 10/1994 Lee
(Continued)

FOREIGN PATENT DOCUMENTS

| | | | |
|---|---|---|---|
| WO | WO2008031139 | A1 | 3/2008 |
| WO | WO2012061905 | A1 | 5/2012 |
| WO | WO2016141345 | A1 | 9/2016 |

OTHER PUBLICATIONS

International Search Report on application No. PCT/SE2018/050233 dated May 22, 2018.

*Primary Examiner* — J C Jacyna
(74) *Attorney, Agent, or Firm* — Moser Taboada

(57) ABSTRACT

The present inventive concept relates to a method for adjusting a water temperature in a water recirculating device. The method comprises determining a first parameter associated with a first water path; determining a second parameter associated with a second water path; determining a setting of a mixing valve arrangement based on the first and second parameter; and adjusting a water temperature of water output by a water outlet based on the setting of the mixing valve arrangement. The invention also relates to a water recirculating device configured to adjust a water temperature of water output by a water outlet based on the setting of the mixing valve arrangement.

10 Claims, 1 Drawing Sheet

(56) References Cited

U.S. PATENT DOCUMENTS

| | | | | |
|---|---|---|---|---|
| 2013/0212800 | A1 | 8/2013 | Kaler et al. | |
| 2014/0053909 | A1* | 2/2014 | Savage | E03B 1/041 137/1 |
| 2016/0320074 | A1 | 11/2016 | Alsadah | |
| 2017/0145669 | A1 | 5/2017 | Klicpera et al. | |
| 2018/0022618 | A1* | 1/2018 | Bertrand | C02F 1/008 210/103 |
| 2019/0003157 | A1* | 1/2019 | Greidanus | E03C 1/00 |
| 2019/0003158 | A1* | 1/2019 | De Jong | E03C 1/0408 |
| 2019/0301145 | A1* | 10/2019 | Ridell | C02F 1/001 |
| 2019/0323210 | A1* | 10/2019 | Mahdjoubi Namin | E03B 1/041 |
| 2020/0141838 | A1* | 5/2020 | Ridell | G01N 33/18 |
| 2020/0299936 | A1* | 9/2020 | Boden | E03B 1/044 |

* cited by examiner

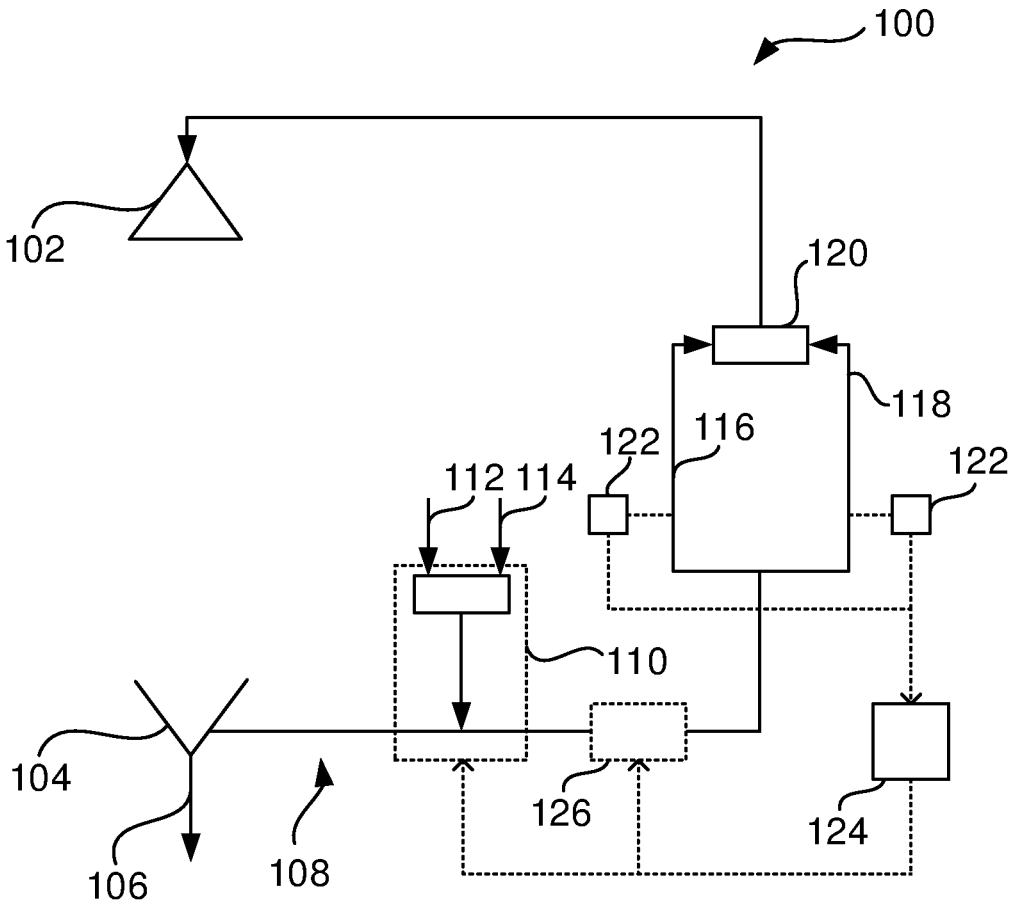
100
102
120
118
116
122
122
112
114
110
104
106
108
126
124

WATER RECIRCULATION DEVICE AND METHOD FOR ADJUSTING A WATER TEMPERATURE IN A WATER RECIRCULATING DEVICE

TECHNICAL FIELD

The inventive concept described herein generally relates to the field of water use efficiency and, more specifically, to a water recirculating devices and a method for adjusting a water temperature in a water recirculating device.

BACKGROUND

In many parts of the world, water is becoming a scarce commodity. Consequently, systems for purification and recycling of water has found applications across many fields. Conventional water recirculating devices can be effective, but are often costly, and requires frequent maintenance and major modifications to existing water infrastructure. There is therefore a need for improved water recirculating devices in terms of cost effectiveness, ease of installation and use, and customizability.

SUMMARY OF THE INVENTION

It is an object of the present inventive concept to mitigate, alleviate or eliminate one or more of the above-identified deficiencies in the art and disadvantages singly or in combination.

According to a first aspect of the inventive concept, these and other objects are achieved in full, or at least in part, by a method for adjusting a water temperature in a water recirculating device comprising: a water outlet configured to output water; a collecting element configured to collect water output from the water outlet; a discard path configured to discard water from the water recirculating device; a recirculating path in liquid communication with the collecting element and the water outlet; an external mixing valve arrangement in liquid communication with the recirculating path, the external mixing valve arrangement accepting as inputs at least hot and cold water from a hot and cold water source respectively; a flow path divider arranged in the recirculating path downstream of the external mixing valve arrangement, wherein the flow path divider is arranged to divide the recirculating path into a first water path and a second water path; and a mixing valve arrangement configured to accept as inputs water from the first and second water path and to output water to the water outlet; wherein the method comprises: determining a first parameter associated with the first water path; determining a second parameter associated with the second water path; determining a setting of the mixing valve arrangement based on the first and second parameter; and adjusting a water temperature of water output by the water outlet based on the setting of the mixing valve arrangement.

Adjusting the water temperature may comprise adjusting the external mixing valve arrangement to mix the hot and cold water based on the setting of the mixing valve arrangement.

Adjusting the water temperature may comprise heating water in the water recirculating device by a heating arrangement.

At least one of the first and second parameter may be a flow rate of water in the first and second water path respectively.

At least one of the first and second parameter may be a pressure in the first and second water path respectively.

According to a second aspect of the inventive concept, these and other objects are achieved in full, or at least in part, by a water recirculating device comprising: a water outlet configured to output water; a collecting element for collecting water output from the water outlet; a discard path configured to discard water from the water recirculating device; a recirculating path in liquid communication with the collecting element and the water outlet; an external mixing valve arrangement in liquid communication with the recirculating path, the external mixing valve arrangement accepting as inputs at least hot and cold water from a hot and cold water source respectively; a flow path divider arranged in the recirculating path downstream of the external mixing valve arrangement, wherein the flow path divider is arranged to divide the recirculating path into a first water path and a second water path; a mixing valve arrangement configured to accept as inputs water from the first and second water path and to output water to the water outlet; a sensor arrangement configured to determine a first and second parameter associated with the first and second water path respectively; and a control unit configured to determine a setting of the mixing valve arrangement based on the first and second parameter; wherein the water recirculating device is configured to adjust a water temperature of water output by the water outlet based on the setting of the mixing valve arrangement.

The external mixing valve arrangement may be configured to mix the hot and cold based on the setting of the mixing valve arrangement in order to adjust the water temperature of water output by the water outlet.

The water recirculating device may further comprise a heating arrangement configured to heat water in the water recirculating device based on the setting of the mixing valve arrangement in order to adjust the water temperature of water output by the water outlet.

At least one of the first and second parameter may be a flow rate of water in the first and second water path respectively, and wherein the sensor arrangement comprises at least one flow rate sensor.

At least one of the first and second parameter may be a pressure in the first and second water path respectively, and wherein the sensor arrangement comprises at least one pressure sensor.

A feature described in relation to one aspect may also be incorporated in other aspects, and the advantage of the feature is applicable to all aspects in which it is incorporated.

Other objectives, features and advantages of the present inventive concept will appear from the following detailed disclosure, from the attached claims as well as from the drawings.

Generally, all terms used in the claims are to be interpreted according to their ordinary meaning in the technical field, unless explicitly defined otherwise herein. Further, the use of terms "first", "second", and "third", and the like, herein do not denote any order, quantity, or importance, but rather are used to distinguish one element from another. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present inventive concept, will be better understood through the following illustrative and non-limiting detailed description of different embodiments of the present inventive concept, with reference to the appended drawings, wherein:

FIG. 1 schematically illustrates a water recirculating device.

DETAILED DESCRIPTION

The present disclosure relates to water recirculating devices. Initially, some terminology may be defined to provide clarification for the following disclosure.

In general, the inventive concept is based on the realization that a setting of a mixing valve arrangement may be determined by determining a first and second parameter of a first and second water path arranged in liquid communication with the mixing valve arrangement. An advantage of this arrangement is that the water recirculating device is less dependent on the mixing valve arrangement. Hereby, a water recirculating device may utilize a wide range of mixing valve arrangements.

Further, the mixing valve arrangement may provide a user input interface with respect to a flow rate and/or a temperature of water output by a water outlet of the water recirculating device. Thus, by determining a setting of the mixing valve arrangement, it may be possible to determine a desired temperature of water output by the water recirculating device.

The mixing valve arrangement referred to in the following disclosure is typically of a single-control type having a single handle or lever so that motion of the handle or level in a first direction controls the rate of flow, whereas motion of the handle in a direction perpendicular to the first direction controls the temperature of water. However, other types of mixing valve arrangements are possible, such as mixing valve arrangements comprising two rotatable knobs controlling the flow rate and temperature respectively.

Throughout the present disclosure, reference is made to different paths. Such paths may be for example pipes for transporting water.

Throughout the present disclosure, references are made to "hot water" and "cold water". Hot water may refer to water having a higher temperature than cold water. Cold water may refer to water having a lower temperature than hot water. It is to be understood that the quality of hot and cold water with respect to temperature and contaminants may vary between applications of the water recirculating device, and between different countries wherein the water recirculating device is located.

Throughout the present disclosure, references are made to features being arranged "downstream" and/or "upstream" of certain features. The flow direction to which the terms "downstream" and "upstream" refer should be understood to be a flow direction from the collecting element to the outlet. In other words, the "stream" referred to in the terms "downstream" and "upstream" is a stream flowing from the collecting element to the outlet.

Water collected in the collecting element 104 may hereafter be referred to as used water. Water treated by a water treatment arrangement may hereafter be referred to as treated water. Water from a hot or cold water source may hereafter be referred to as external water.

FIG. 1 illustrates a water recirculating device 100 comprising: a water outlet 102 configured to output water; a collecting element 104 for collecting water output from the water outlet 102; a discard path 106 configured to discard water from the water recirculating device 100; a recirculating path 108 in liquid communication with the collecting element 104 and the water outlet 102; an external mixing valve arrangement 110 in liquid communication with the recirculating path 108, the external mixing valve arrangement 110 accepting as inputs at least hot and cold water from a hot and cold water source 112, 114 respectively; a flow path divider arranged in the recirculating path 108 downstream of the external mixing valve arrangement 110, wherein the flow path divider is arranged to divide the recirculating path 108 into a first water path 116 and a second water path 118; a mixing valve arrangement 120 configured to accept as inputs water from the first and second water path 116, 118 and to output water to the water outlet 102; a sensor arrangement 122 configured to determine a first and second parameter associated with the first and second water path 116, 118 respectively; and a control unit 124 configured to determine a setting of the mixing valve arrangement 120 based on the first and second parameter; wherein the water recirculating device 100 is configured to adjust a water temperature of water output by the water outlet 102 based on the setting of the mixing valve arrangement 120.

The water recirculating device 100 may be a shower, such as a hair shower in a hair salon. It can be mentioned that the water recirculating device 100 is illustrated having one outlet 102. However, the water recirculating device may be provided with several outlets in liquid communication with the recirculating path 108.

The collecting element may be arranged upstream of a drain.

The external mixing valve arrangement 110 may further accept as input used water collected by the collecting element 104.

The water recirculating device 100 may comprise a heating arrangement 126 configured to heat water in the water recirculating device 100.

The water recirculating device 100 may recirculate water output by the outlet 102 and collected by the collecting element 103 in the recirculating path 108 and, if needed, withdraw external water from the hot and cold water source 112, 114. Hereby, water consumption for e.g. a shower can be decreased. The water recirculating device may comprise a water treatment arrangement arranged in the recirculating path 108. The water treatment arrangement is preferable arranged downstream of the external mixing valve arrangement 110 such that external water can be treated.

The first and second parameter associated with the first and second water path 116, 118 may be a flow rate of water in the first and second water path 116, 118 respectively. In this context, the first and second parameter may be determined in several ways.

For example, the sensor arrangement may comprise a flow rate sensor 122 arranged in each of the first and second water path 116, 118.

It may also be possible to provide one of the first and second water path 116, 118 with a flow rate sensor, and arrange another flow rate sensor downstream and/or upstream of the first and second water path 116, 118. Hereby, a flow rate of water in both the first and second water path 116, 118 can be determined if the sum of these flows are equal to a flow rate of water downstream and/or upstream of the first and second water path 116, 118.

It may also be possible to provide one of the first and second water path 116, 118 with a flow rate sensor if the water recirculating device is configured such that a flow rate of water upstream and/or downstream of the first and second water path 116, 118 is pre-determined and therefore known.

The first and second parameter associated with the first and second water path 116, 118 may be a pressure in the first and second water path 116, 118 respectively. The sensor arrangement may comprise a pressure sensor arranged in each of the first and second water path 116, 118.

The control unit 124 may be configured to receive data associated with the first and second parameter. The control unit may be configured to adjust the external mixing valve arrangement 110 and/or the heating arrangement 126.

The inventive concept has mainly been described above with reference to a few embodiments. However, as is readily appreciated by a person skilled in the art, other embodiments than the ones disclosed above are equally possible within the scope of the inventive concept, as defined by the appended patent claims.

LIST OF REFERENCE SIGNS

100 Water recirculating device
102 Outlet
104 Collecting element
106 Discard path
108 Recirculating path
110 External mixing valve arrangement
112 Hot water source
114 Cold water source
116 First water path
118 Second water path
120 Mixing valve arrangement
122 Sensor arrangement
124 Control unit
126 Heating arrangement

The invention claimed is:

1. A method for adjusting a water temperature in a water recirculating device comprising:

a water outlet configured to output water;

a collecting element configured to collect water output from the water outlet;

a discard path configured to discard water from the water recirculating device;

a recirculating path in liquid communication with the collecting element and the water outlet;

an external mixing valve arrangement in liquid communication with the recirculating path, the external mixing valve arrangement accepting as inputs at least hot and cold water from a hot and cold water source respectively;

a flow path divider arranged in the recirculating path downstream of the external mixing valve arrangement, wherein the flow path divider is arranged to divide the recirculating path into a first water path and a second water path; and a mixing valve arrangement configured to accept as inputs water from the first and second water path and to output water to the water outlet;

wherein the method comprises:

determining a first parameter associated with the first water path;

determining a second parameter associated with the second water path;

determining a setting of the mixing valve arrangement based on the first and second parameter; and adjusting a water temperature of water output by the water outlet based on the setting of the mixing valve arrangement.

2. The method according to claim 1, wherein adjusting the water temperature comprises adjusting the external mixing valve arrangement to mix the hot and cold water based on the setting of the mixing valve arrangement.

3. The method according to claim 1, wherein adjusting the water temperature comprises heating water in the water recirculating device by a heating arrangement.

4. The method according to claim 1, wherein at least one of the first and second parameter is a flow rate of water in the first and second water path respectively.

5. The method according to claim 1, wherein at least one of the first and second parameter is a pressure in the first and second water path respectively.

6. A water recirculating device comprising:

a water outlet configured to output water;

a collecting element for collecting water output from the water outlet;

a discard path configured to discard water from the water recirculating device;

a recirculating path in liquid communication with the collecting element and the water outlet;

an external mixing valve arrangement in liquid communication with the recirculating path, the external mixing valve arrangement accepting as inputs at least hot and cold water from a hot and cold water source respectively;

a flow path divider arranged in the recirculating path downstream of the external mixing valve arrangement, wherein the flow path divider is arranged to divide the recirculating path into a first water path and a second water path;

a mixing valve arrangement configured to accept as inputs water from the first and second water path and to output water to the water outlet;

a sensor arrangement configured to determine a first and second parameter associated with the first and second water path respectively; and a control unit configured to determine a setting of the mixing valve arrangement based on the first and second parameter;

wherein the water recirculating device is configured to adjust a water temperature of water output by the water outlet based on the setting of the mixing valve arrangement.

7. The water recirculating device according to claim 6, wherein the external mixing valve arrangement is configured to mix the hot and cold based on the setting of the mixing valve arrangement in order to adjust the water temperature of water output by the water outlet.

8. The water recirculating device according to claim 6, further comprising a heating arrangement configured to heat water in the water recirculating device based on the setting of the mixing valve arrangement in order to adjust the water temperature of water output by the water outlet.

9. The water recirculating device according to claim 6, wherein at least one of the first and second parameter is a flow rate of water in the first and second water path respectively, and wherein the sensor arrangement comprises at least one flow rate sensor.

10. The water recirculating device according to claim 6, wherein at least one of the first and second parameter is a pressure in the first and second water path respectively, and wherein the sensor arrangement comprises at least one pressure sensor.

* * * * *